US009570823B2

(12) United States Patent
Lai et al.

(10) Patent No.: US 9,570,823 B2
(45) Date of Patent: Feb. 14, 2017

(54) PCI-E CONNECTOR COVER AND PCI-E CONNECTOR MODULE

(71) Applicant: GIGA-BYTE TECHNOLOGY CO., LTD., New Taipei (TW)

(72) Inventors: Chih-Ming Lai, New Taipei (TW); Chung-Wei Chiang, New Taipei (TW); Yung-Shun Kao, New Taipei (TW)

(73) Assignee: GIGA BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/804,347

(22) Filed: Jul. 21, 2015

(65) Prior Publication Data

US 2016/0336665 A1 Nov. 17, 2016

(30) Foreign Application Priority Data

May 13, 2015 (TW) ..... 104115224 A

(51) Int. Cl.
*H01R 24/00* (2011.01)
*H01R 12/70* (2011.01)

(52) U.S. Cl.
CPC ..... *H01R 12/7076* (2013.01)

(58) Field of Classification Search
CPC ..... H01R 12/7076; H01R 12/70
USPC ..... 439/630, 629, 626
See application file for complete search history.

(56) References Cited

U.S. PATENT DOCUMENTS 5,035,631 A * 7/1991 Piorunneck ..... H01R 13/65802 439/108
5,478,259 A * 12/1995 Noschese ..... H01R 12/721 439/108
5,508,889 A * 4/1996 Ii ..... H05K 9/0028 174/368
5,876,247 A * 3/1999 Hashimoto ..... H01R 23/6873 439/607.56
5,947,769 A * 9/1999 Leonard ..... H01R 23/6873 439/108
6,050,852 A * 4/2000 Wu ..... H01R 13/629 439/607.02
6,056,560 A * 5/2000 Wu ..... H01R 23/6873 439/108
6,093,046 A * 7/2000 Chiou ..... H01R 12/7005 439/378

(Continued)

OTHER PUBLICATIONS

"Search report of Europe Counterpart Application", issued on Sep. 29, 2016, p. 1-p. 11.

*Primary Examiner* — Tulsidas C Patel
*Assistant Examiner* — Peter G Leigh
(74) *Attorney, Agent, or Firm* — Jianq Chyun IP Office

(57) ABSTRACT

A PCI-E connector cover includes a first, a second cover lateral sides, a plurality of bending arms, a cover top surface and a plurality of connecting posts. The first, the second cover lateral sides and the cover top surface are adapted to cover a first, a second connector lateral sides and a connector top surface of a PCI-E connector. The bending arms are connected to the first cover lateral side and lean against a first connector concave of the PCI-E connector so as to keep an interval between the first cover lateral side and the first connector concave. The cover top surface is connected to the first, the second cover lateral sides. The connecting posts are extended from the first and the second cover lateral sides to fix to a main board. A PCI-E connector module is further provided.

18 Claims, 13 Drawing Sheets

(56) References Cited

U.S. PATENT DOCUMENTS 6,238,219 B1 * 5/2001 Wu ..... H01R 13/24 439/289
6,293,826 B1 * 9/2001 Shi ..... H01R 12/721 439/607.01
6,319,060 B1 * 11/2001 Wu ..... H01R 23/6873 439/108
6,358,079 B1 * 3/2002 Noble ..... H01R 12/7005 439/326
6,379,186 B1 * 4/2002 Shi ..... H01R 23/6873 439/569
6,478,623 B1 * 11/2002 Wu ..... H01R 13/65802 439/607.35
6,485,328 B1 * 11/2002 Wu ..... H01R 23/6873 439/567
6,619,984 B2 * 9/2003 Liu ..... H01R 13/6594 439/607.4
6,655,976 B1 * 12/2003 Shipe ..... H05K 7/1405 439/325
6,663,402 B1 * 12/2003 Yu ..... H01R 13/65802 439/108
6,672,887 B1 * 1/2004 Yu ..... H01R 13/65802 439/108
6,702,615 B1 * 3/2004 Fan ..... H01R 23/6873 439/607.01
6,749,445 B1 * 6/2004 Chen ..... H05K 3/301 439/65
6,755,690 B1 * 6/2004 Zhang ..... H01R 23/6873 439/607.02
6,805,585 B1 10/2004 Ko
6,821,149 B2 * 11/2004 Lai ..... H01R 23/6873 439/607.31
6,908,339 B2 * 6/2005 Tanaka ..... H01R 12/707 439/564
6,942,509 B2 * 9/2005 Sasame ..... H01R 13/6485 439/101
7,008,267 B2 * 3/2006 Fan ..... H01R 23/6873 439/108
7,052,286 B2 * 5/2006 Zhang ..... H01R 23/6873 439/108
7,083,423 B1 * 8/2006 Guerra, Jr. ..... H01R 12/58 439/61
7,083,470 B2 * 8/2006 Zhang ..... H01R 23/6873 439/607.36
7,108,554 B2 * 9/2006 Huang ..... H01R 23/6873 439/378
D582,860 S * 12/2008 Sasaki ..... D13/147
7,771,232 B2 * 8/2010 Si ..... H01R 23/6873 439/607.01
7,785,149 B2 * 8/2010 Kamata ..... H01R 13/6275 439/570
8,348,701 B1 * 1/2013 Lan ..... H01R 12/707 439/607.19
8,444,438 B2 * 5/2013 Gao ..... H01R 13/6582 439/607.35
8,944,850 B2 * 2/2015 Simmel ..... H01R 43/20 439/607.55
9,065,225 B2 * 6/2015 Degner ..... H01R 12/721
2005/0277334 A1 * 12/2005 Huang ..... H01R 23/6873 439/607.01
2007/0155245 A1 7/2007 Tsai

* cited by examiner

PCI-E CONNECTOR COVER AND PCI-E CONNECTOR MODULE

CROSS-REFERENCE TO RELATED APPLICATION

This application claims the priority benefit of Taiwan application serial no. 104115224, filed on May 13, 2015. The entirety of the above-mentioned patent application is hereby incorporated by reference herein and made a part of this specification.

BACKGROUND OF THE INVENTION

Field of the Invention

The invention relates to a connector cover and a connector module, and particularly relates to a peripheral component interconnect express (PCI-E) connector cover and a PCI-E connector module.

Description of Related Art

Along with quick development of technology, performance of expansion devices in a computer host is continuously improved. Taking a display card as an example, it produces a large amount of heat during a high performance operation, and in order to improve a heat dissipation effect, the display card sold in the market is generally configured with a fan at one side thereof, so as to quickly dissipate the heat produced by chips on the display card in a convection manner. However, since a weight of such type of the display card is relatively high, when the display card is plugged to a connector on a main board, a casing of the connector is probably cracked.

SUMMARY OF THE INVENTION

The invention is directed to a peripheral component interconnect express (PCI-E) connector cover, which protects a PCI-E connecter to decrease a chance of cracking the PCI-E connector.

The invention is directed to a PCI-E connector module, which has the aforementioned PCI-E connector cover.

The invention provides a PCI-E connector cover, which is adapted to cover a PCI-E connector and fixed to a main board. The PCI-E connector includes a connector top surface and a connector bottom surface opposite to each other, a first connector lateral side and a second connector lateral side opposite to each other, a third connector lateral side and a fourth connector lateral side opposite to each other. The first connector lateral side includes a first connector concave and a plurality of connector protrusions, and the second connector lateral side includes a second connector concave. The PCI-E connector cover includes a first cover lateral side, a plurality of bending arms, a second cover lateral side, a cover top surface and a plurality of connecting posts. The first cover lateral side is adapted to cover the first connector lateral side. The bending arms are connected to the first cover lateral side and adapted for lean against the first connector concave to keep an interval between the first cover lateral side and the first connector concave. The second cover lateral side is adapted to cover the second connector lateral side. The cover top surface is connected to the first cover lateral side and the second cover lateral side, and is adapted to cover the connector top surface. The connecting posts are extended from the first cover lateral side and the second cover lateral side, where the PCI-E connector cover is adapted to be connected to the main board through the connecting posts.

In an embodiment of the invention, the bending arms are extended from an edge of the first cover lateral side and are bended towards the first connector concave.

In an embodiment of the invention, the bending arms are formed by cracking and bending a plurality partial regions of the first cover lateral side at non-edge areas, such that the first cover lateral side has a plurality of cracking holes besides the bending arms.

In an embodiment of the invention, the bending arms contact or do not contact the connector protrusions of the first connector lateral side.

In an embodiment of the invention, the first cover lateral side has a first cover concave, or the second cover lateral side has a second cover concave.

In an embodiment of the invention, the second cover lateral side has a curvature concaving towards the first cover lateral side, or the first cover lateral side has a curvature concaving towards the second cover lateral side.

In an embodiment of the invention, the connecting posts are grounding posts.

In an embodiment of the invention, each of the connecting posts has a rough surface, a bending portion or a cracking hole.

In an embodiment of the invention, the PCI-E connector cover further includes a third cover lateral side, a first buckling portion and at least one second buckling portion. The third cover lateral side is connected to at least two of the cover top surface, the first cover lateral side and the second cover lateral side, and is adapted to cover the third connector lateral side. The first buckling portion is extended from the third cover lateral side. The at least one second buckling portion is extended from the first cover lateral side or the second cover lateral side, where the first buckling portion and the at least one second buckling portion are adapted to bend for respectively buckling the connector bottom surface and the fourth connector lateral side of the PCI-E connector.

In an embodiment of the invention, the at least one second buckling portion includes two second buckling portions respectively extended from the first cover lateral side and the second cover lateral side.

The invention provides a PCI-E connector module, which is adapted to be fixed to a main board, the PCI-E connector module includes a PCI-E connector and a PCI-E connector cover. The PCI-E connector includes a connector top surface and a connector bottom surface opposite to each other, a first connector lateral side and a second connector lateral side opposite to each other, a third connector lateral side and a fourth connector lateral side opposite to each other. The first connector lateral side includes a first connector concave and a plurality of connector protrusions, the second connector lateral side includes a second connector concave. The PCI-E connector cover includes a first cover lateral side, a plurality of bending arms, a second cover lateral side, a cover top surface and a plurality of connecting posts. The first cover lateral side covers the first connector lateral side. The bending arms are connected to the first cover lateral side and lean against the first connector concave to keep an interval between the first cover lateral side and the first connector concave. The second cover lateral side covers the second connector lateral side. The cover top surface is connected to the first cover lateral side and the second cover lateral side, and covers the connector top surface. The connecting posts are extended from the first cover lateral side and the second cover lateral side, where the PCI-E connector cover is adapted to be connected to the main board through the connecting posts.

In an embodiment of the invention, the bending arms are extended from an edge of the first cover lateral side and are bended towards the first connector concave.

In an embodiment of the invention, the bending arms are fonned by cracking and bending a plurality partial regions of the first cover lateral side at non-edge areas, such that the first cover lateral side has a plurality of cracking holes besides the bending arms.

In an embodiment of the invention, the bending arms contact or do not contact the connector protrusions of the first connector lateral side.

In an embodiment of the invention, the first cover lateral side has a first cover concave, or the second cover lateral side has a second cover concave.

In an embodiment of the invention, the second cover lateral side has a curvature concaving towards the first cover lateral side, or the first cover lateral side has a curvature concaving towards the second cover lateral side.

In an embodiment of the invention, the connecting posts are grounding posts.

In an embodiment of the invention, each of the connecting posts has a rough surface, a bending portion or a cracking hole.

In an embodiment of the invention, the PCI-E connector cover further includes a third cover lateral side, a first buckling portion and at least one second buckling portion. The third cover lateral side is connected to at least two of the cover top surface, the first cover lateral side and the second cover lateral side, and covers the third connector lateral side. The first buckling portion is extended from the third cover lateral side. The at least one second buckling portion is extended from the first cover lateral side or the second cover lateral side, where the first buckling portion and the at least one second buckling portion are adapted to bend for respectively buckling the connector bottom surface and the fourth connector lateral side of the PCI-E connector.

In an embodiment of the invention, the at least one second buckling portion includes two second buckling portions respectively extended from the first cover lateral side and the second cover lateral side.

According to the above descriptions, the cover top surface of the PCI-E connector cover of the PCI-E connector module is connected to the first cover lateral side and the second cover lateral side, and the cover top surface, the first cover lateral side and the second cover lateral side are adapted to cover the connector top surface, the first connector lateral side and the second connector lateral side of the PCI-E connector to enhance a structural strength of the PCI-E connector. Moreover, the bending arms connected to the first cover lateral side lean against the first connector concave of the PCI-E connector, such that a certain interval is kept between the first cover lateral side of the PCI-E connector cover and the first connector concave of the PCI-E connector to avoid a situation that the PCI-E connector cover is sunk and deformed under pressure. Moreover, the PCI-E connector cover is stably connected to the main board through the connecting posts in a welding manner.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
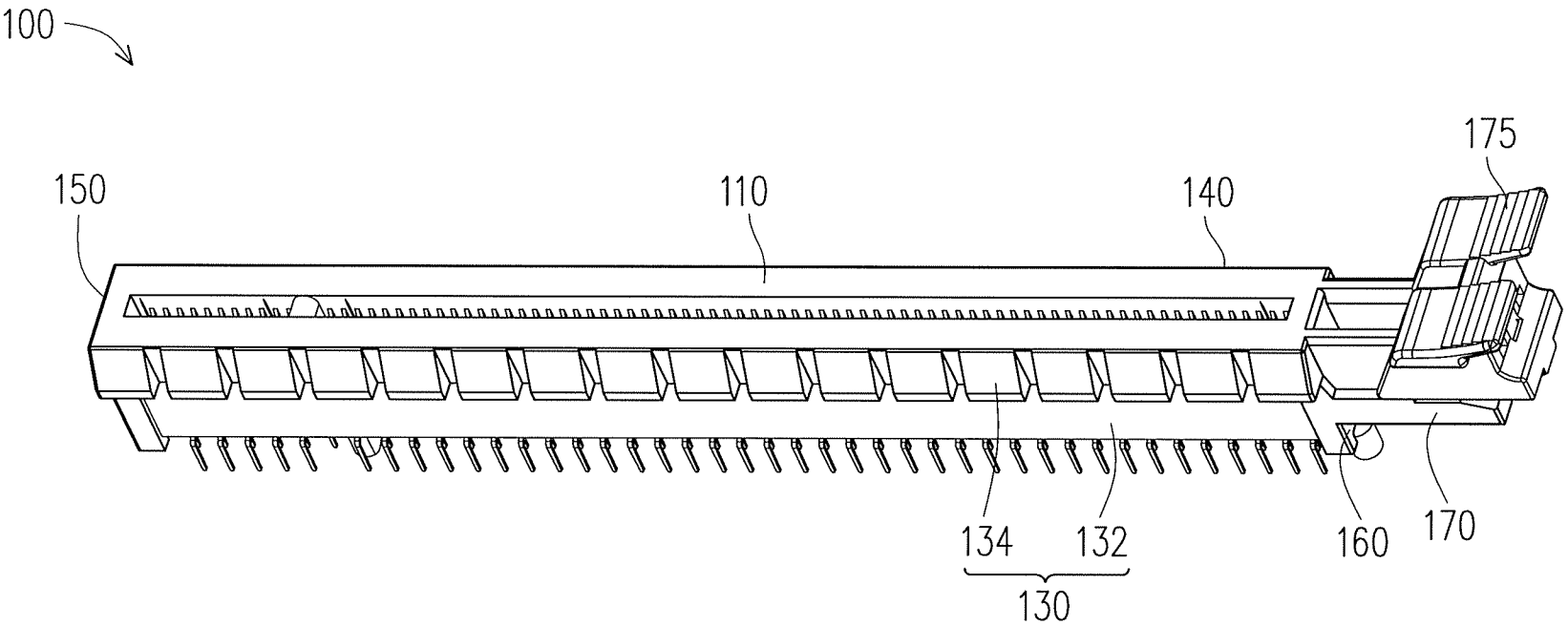
FIG. 1 (RELATED ART)
FIG. 1 is a schematic diagram of a conventional PCI-E connector.
Figure 2:
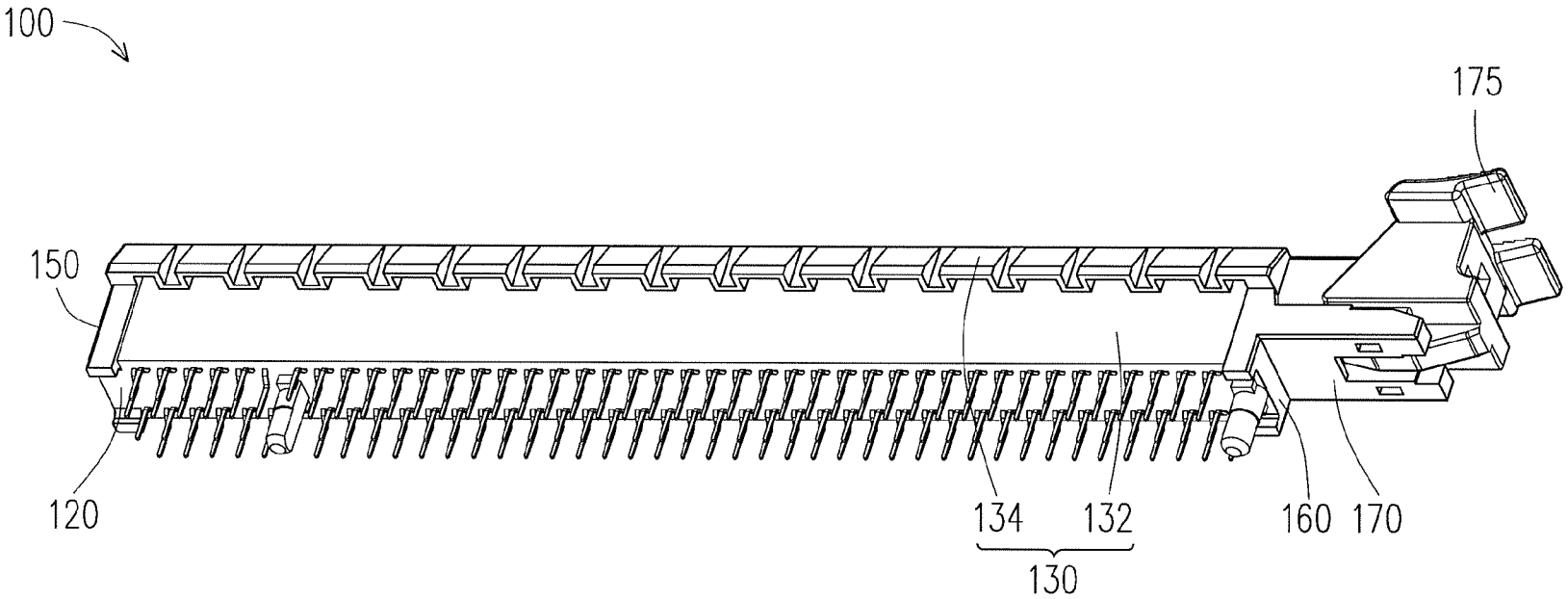
FIG. 2 (RELATED ART)
FIG. 2 and FIG. 3 are respectively schematic diagrams of the conventional PCI-E connector of FIG. 1 viewing along different viewing angles.
Figure 3:
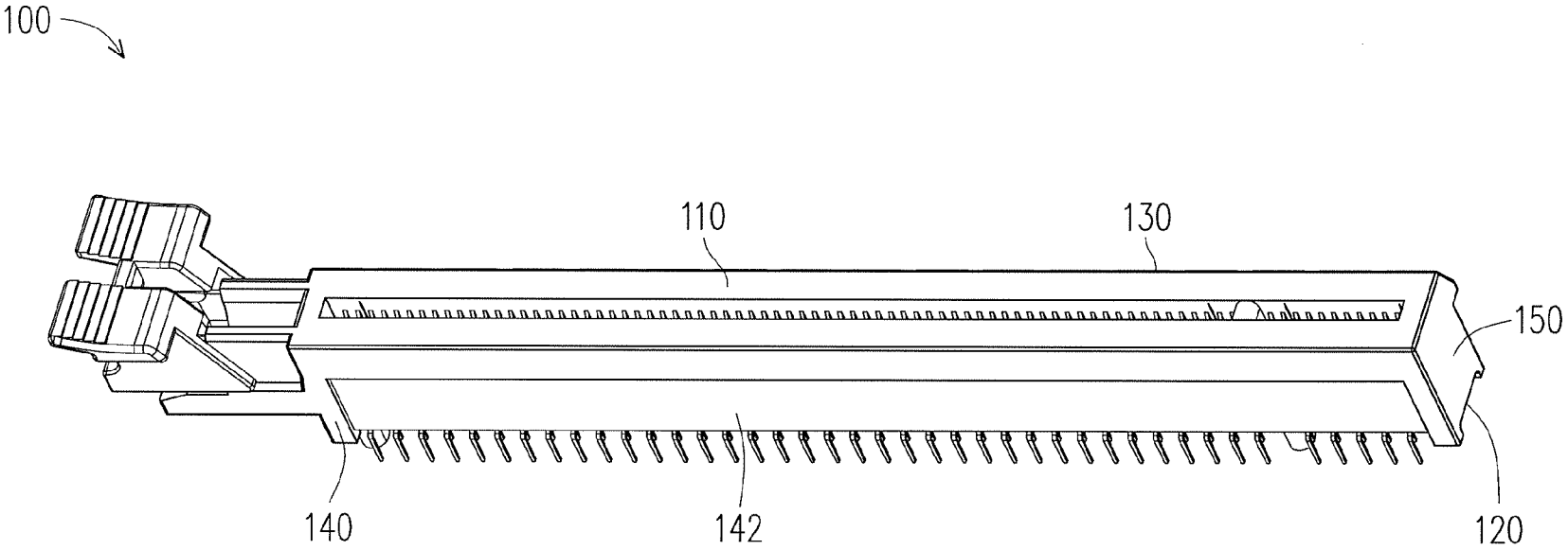
FIG. 3 (RELATED ART)

FIG. 1 is a schematic diagram of a conventional peripheral component interconnect express (PCI-E) connector. FIG. 2 and FIG. 3 are respectively schematic diagrams of the conventional PCI-E connector of FIG. 1 viewing along different viewing angles. Referring to FIG. 1 to FIG. 3, the PCI-E connector 100 includes a connector top surface 110 and a connector bottom surface 120 opposite to each other, a first connector lateral side 130 and a second connector lateral side 140 opposite to each other, a third connector lateral side 150 and a fourth connector lateral side 160 opposite to each other.

The connector top surface 110 and the connector bottom surface 120 are respectively connected to the first connector lateral side 130, the second connector lateral side 140, the third connector lateral side 150 and the fourth connector lateral side 160. As shown in FIG. 1 and FIG. 2, the first connector lateral side 130 includes a first connector concave 132 and a plurality of connector protrusions 134, where the connector protrusions 134 are closer to the connector top surface 110 compared with the first connector concave 132. Moreover, as shown in FIG. 3, the second connector lateral side 140 includes a second connector concave 142. The fourth connector lateral side 160 has an extending post 170 protruding out of the fourth connector lateral side 160 and a pull knob 175 rotatably disposed on the extending post 170.

The PCI-E connector 100 can be disposed on a main board (not shown), and an expansion card (not shown) can be inserted into a slot on the connector top surface 110, such that the expansion card can be electrically connected to the main board through pins of the PCI-E connector 100. When the expansion card is to be unplugged, the pull knob 175 can be pushed to separate the expansion card from the slot of the connector top surface 110. The expansion card can be a display card, though the type of the expansion card is not limited thereto.

Generally, since a material of a casing of the PCI-E connector 100 is plastic, limited by such material, a structural strength of the PCI-E connector 100 is poor, and if the expansion card inserted in the PCI-E connector 100 is overweight, or if a user conducts an improper operation when unplugging the expansion card, the PCI-E connector 100 is probably cracked. In order to decrease a chance of cracking the PCI-E connector 100, the present embodiment provides a PCI-E connector module 10 having better structural strength, and details thereof are as follows.

Figure 4:
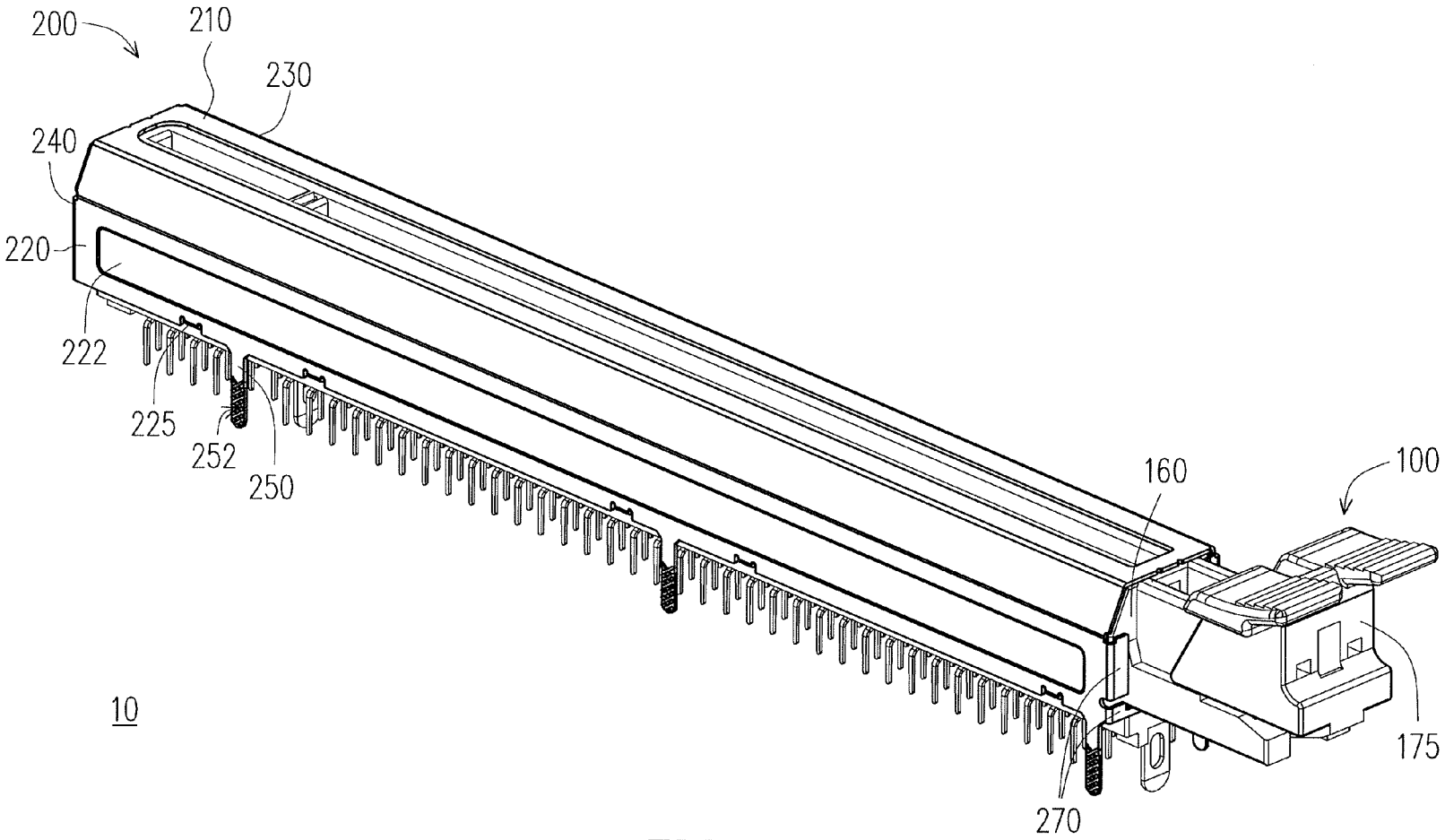
FIG. 4 is a schematic diagram of a PCI-E connector module according to an embodiment of the invention.
Figure 5:
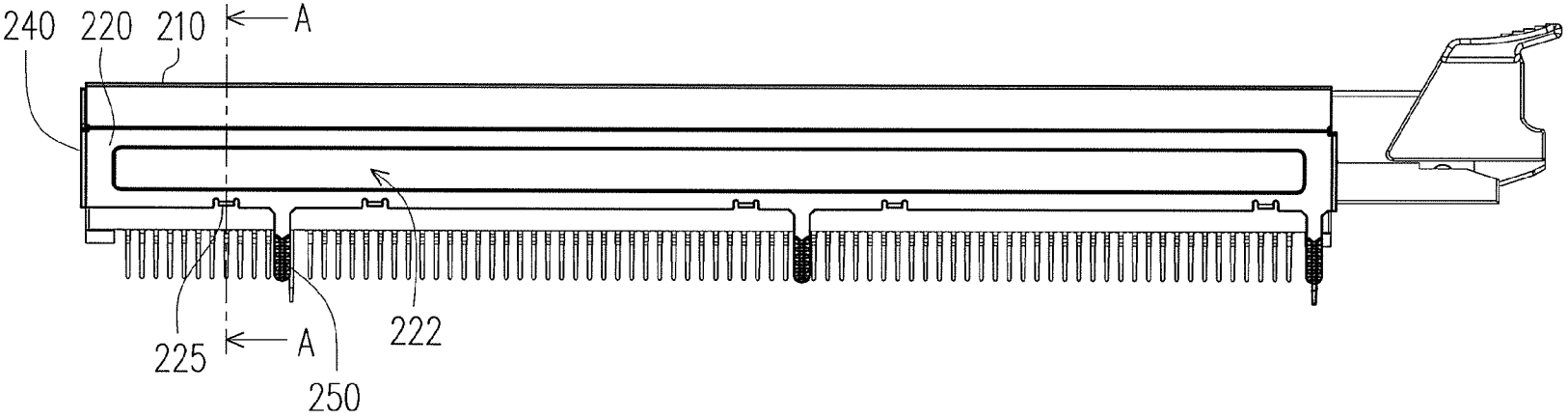
FIG. 5 to FIG. 8 are respectively schematic diagrams of the PCI-E connector module of FIG. 4 viewing along other viewing angles.

FIG. 4 is a schematic diagram of a PCI-E connector module according to an embodiment of the invention. FIG. 5 to FIG. 8 are respectively schematic diagrams of the PCI-E connector module of FIG. 4 viewing along other viewing angles. FIG. 9 is a partial schematic diagram of the PCI-E connector module of FIG. 4 viewing along other viewing angle. FIG. 10 is a cross-sectional view of the PCI-E connector module of FIG. 5 along an A-A line. As shown in FIG. 4, the PCI-E connector module 10 of the present embodiment includes the conventional PCI-E connector 100 and a PCI-E connector cover 200 covering the conventional PCI-E connector 100. In the following figures, the PCI-E connector cover 200 is shown in bold lines to clearly distinguish the PCI-E connector cover 200 and the PCI-E connector 100. In the present embodiment, by covering the PCI-E connector cover 200 with a metal material on the general PCI-E connector 100, the structural strength of the PCI-E connector 100 is enhanced.

In detail, as shown in FIG. 4 to FIG. 10, in the present embodiment, the PCI-E connector cover 200 includes a cover top surface 210, a first cover lateral side 220, a plurality of bending arms 225, a second cover lateral side 230, a third cover lateral side 240 and a plurality of connecting posts 250.

The cover top surface 210 is connected to the first cover lateral side 220 and the second cover lateral side 230. The third cover lateral side 240 is connected to at least two of the cover top surface 210, the first cover lateral side 220 and the second cover lateral side 230. In the present embodiment, the third cover lateral side 240 is connected to the first cover lateral side 220 and the second cover lateral side 230. The cover top surface 210, the first cover lateral side 220, the second cover lateral side 230 and the third cover lateral side 240 of the PCI-E connector cover 200 are respectively adapted to cover the connector top surface 110, the first connector lateral side 130, the second connector lateral side 140 and the third connector lateral side 150 of the PCI-E connector 100, so as to protect the PCI-E connector 100.

Figure 8:
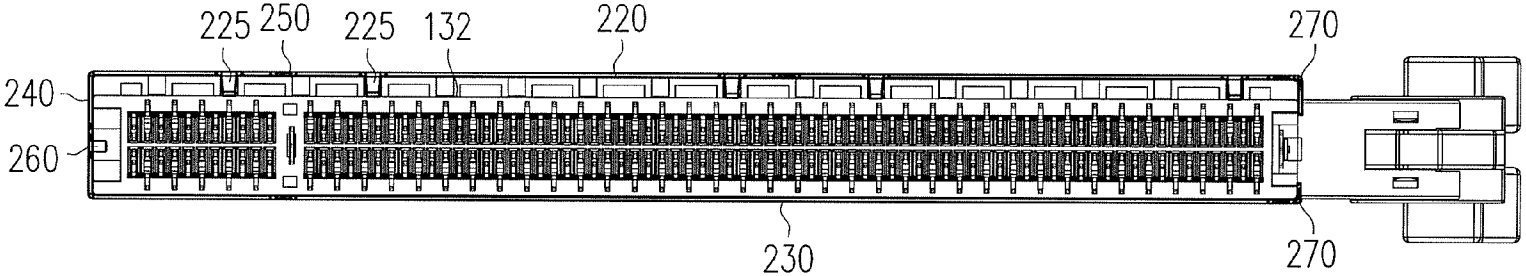
Figure 9:
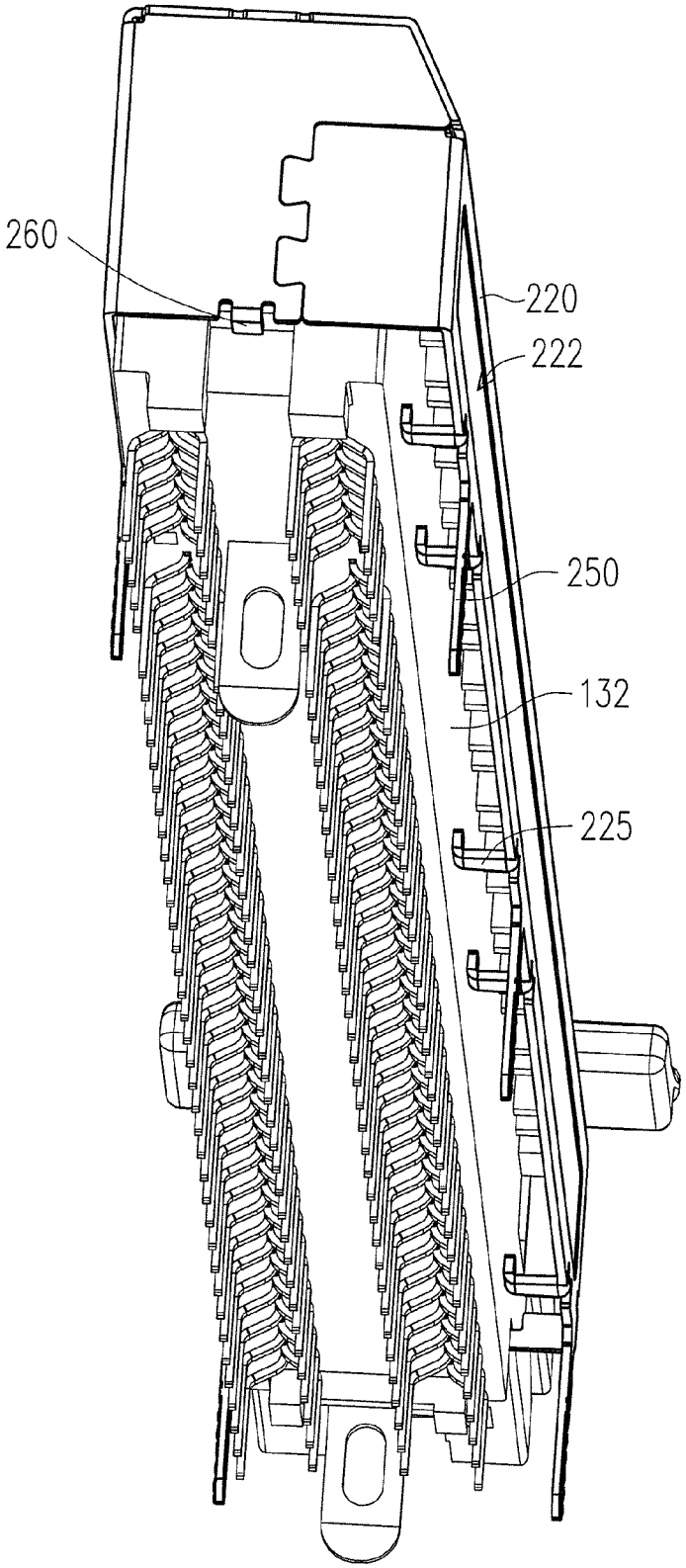
FIG. 9 is a partial schematic diagram of the PCI-E connector module of FIG. 4 viewing along other viewing angle.
Figure 10:
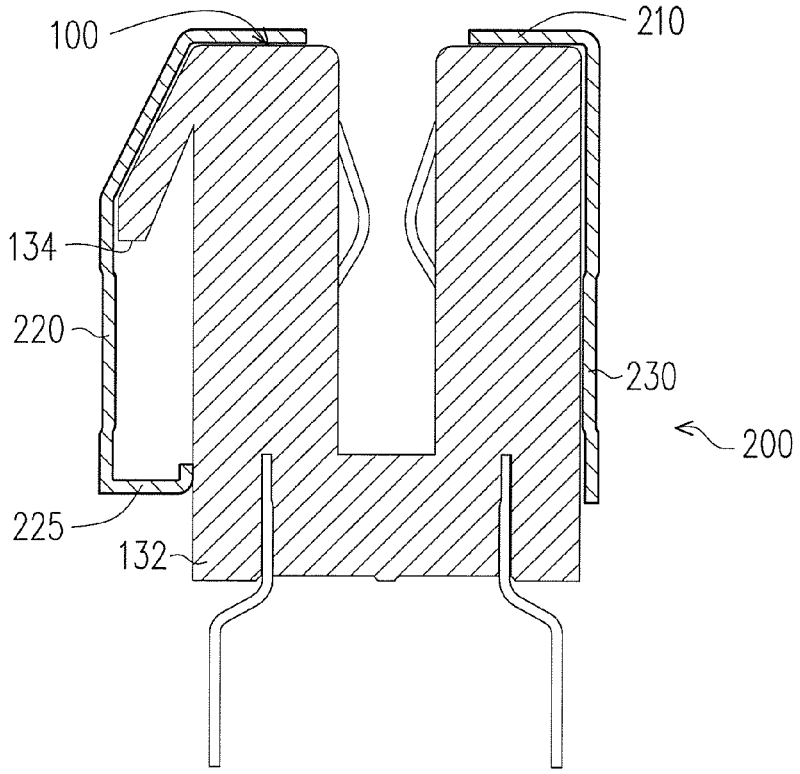
FIG. 10 is a cross-sectional view of the PCI-E connector module of FIG. 5 along an A-A line.

As shown in FIG. 8 to FIG. 10, in the present embodiment, the bending arms 225 are connected to the first cover lateral side 220 and lean against the first connector lateral side 130 to keep an interval between the first cover lateral side 220 of the PCI-E connector cover 200 and the first connector concave 132 of the PCI-E connector 100. To be specific, the bending arms 225 are extended from an edge of the first cover lateral side 220 and are bended towards the first connector concave 132. When the PCI-E connector cover 200 covers the PCI-E connector 100, although the second cover lateral side 230 of the PCI-E connector cover 200 directly contacts the second connector lateral side 140 of the PCI-E connector 100, since the first cover lateral side 220 of the PCI-E connector cover 200 does not directly contact the first connector concave 132 of the PCI-E connector 100, the first cover lateral side 220 of the PCI-E connector cover 200 is liable to be deformed under pressure.

Therefore, in the PCI-E connector cover 200 of the present embodiment, as the bending arms 225 lean against the first connector concave 132, an interval can be kept between the first cover lateral side 220 of the PCI-E connector cover 200 and the first connector concave 132 of the PCI-E connector 100. In this way, when the user takes the PCI-E connector cover 200, the first cover lateral side 220 of the PCI-E connector cover 200 is not liable to concave inward to have a deformation due to excessive force exerted by the user.

Figure 11:
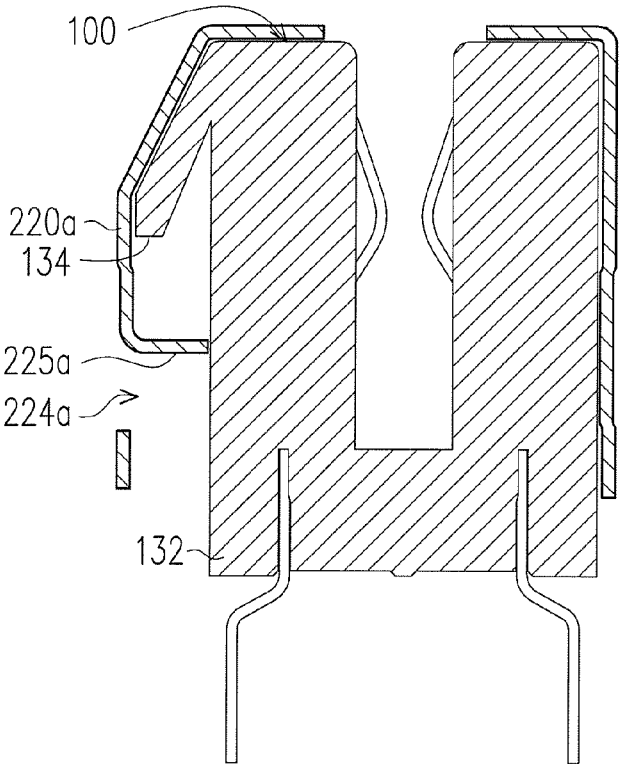
FIG. 11 to FIG. 13 are respectively cross-sectional views of a plurality of PCI-E connector modules according to other embodiments of the invention.
Figure 12:
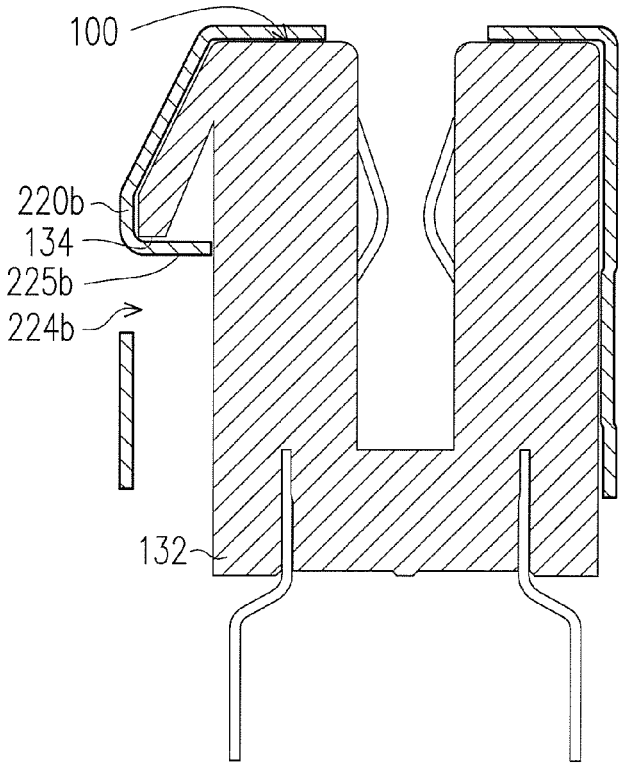
Figure 13:
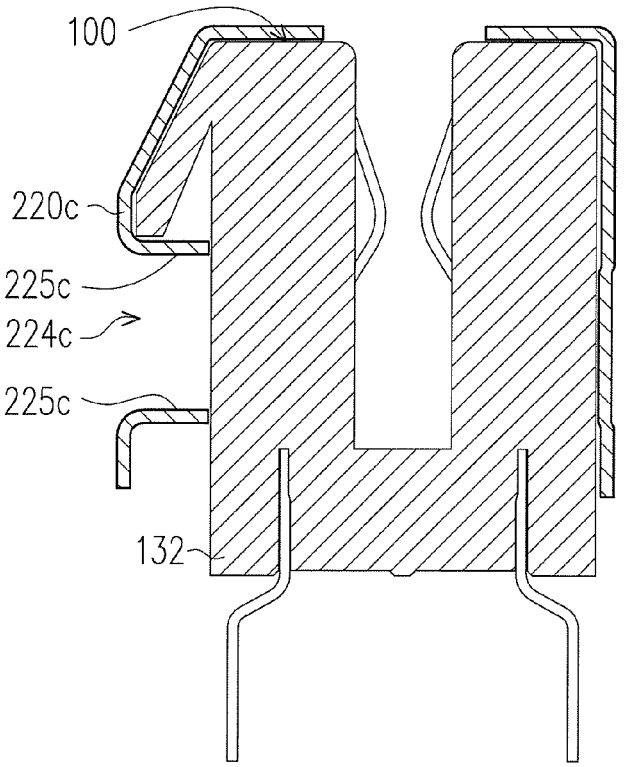

Certainly, only one implementation and configuration positions of the bending arms 225 are described in the aforementioned embodiment, though implementation and configuration positions of the bending arms 225 are not limited thereto, and other implementation of the bending arms is provided below for reference. FIG. 11 to FIG. 13 are respectively cross-sectional views of a plurality of PCI-E connector modules according to other embodiments of the invention. In FIG. 11 to FIG. 13, the PCI-E connector modules adopt the conventional PCI-E connector 100 in FIG. 1, and differences therebetween lie in different implementations of the bending arms on the PCI-E connector cover. It should be noticed that since FIG. 11 to FIG. 13 adopt a same viewing angle with that of FIG. 10, one of the cross-sections of the first cover lateral sides 220*a*, 220*b* and 220*c* are schematically illustrated.

Referring to FIG. 11, in the embodiment of FIG. 11, partial regions of the first cover lateral side 220*a* are cracked at non-edge areas and are bended towards the first connector concave 132 to form the bending arms 225*a*. Namely, the bending alms 225 are not located at the edge of the first cover lateral side 220*a*. Moreover, since the bending arms 225*a* is formed by cracking the partial regions of the first cover lateral side 220*a*, the first cover lateral side 220*a* has a plurality of cracking holes 224*a* besides the bending arms 225*a*, and a size of the cracking hole 224*a* is substantially complied with a size of the bending arm 225*a*.

Referring to FIG. 12, a difference between the embodiment of FIG. 12 and the embodiment of FIG. 11 is that in the embodiment of FIG. 12, positions of the bending arms 225*b* are relatively high, and besides that the bending arms 225*b* lean against the first connector concave 132, the bending arms 225*b* also contact bottom surfaces of the connector protrusions 134. In this structure, besides that the bending arms 225*b* keeps a certain interval between the first cover lateral side 220*b* of the PCI-E connector cover 200*b* and the first connector concave 132 of the PCI-E connector 100, since the bending arms 225*b* contact the bottom surfaces of the connector protrusions 134, an upward movement of the PCI-E connector cover 200*b* relative to the PCI-E connector 100 is limited, so as to achieve an effect that the PCI-E connector cover 200*b* is not easy to be separated from the PCI-E connector 100.

Referring to FIG. 13, in the embodiment of FIG. 13, there are two upper and lower bending arms 225*c* on the first cover lateral side 220*c* at non-edge areas. In FIG. 13, the upper bending arms 225*c* are similar to the bending arms 225*b* of FIG. 12, and a difference between the embodiment of FIG. 13 and the embodiment of FIG. 12 lies in the lower bending arms 225*c* of FIG. 13. The lower bending arms 225*c* are also formed by cracking partial regions of the first cover lateral side 220*c* at non-edge areas and bending the same towards the first connector concave 132. In FIG. 13, since the upper and lower bending arms 225*c* are formed by cracking the partial regions of the first cover lateral side

220*c*, the first cover lateral side 220*c* have corresponding cracking holes 224*c* between the upper and lower bending arms 225*c*, and a size of the cracking hole 224*c* is substantially complied with a total size of the upper and lower bending arms 225*c*.

It should be noticed that in FIG. 13, the sizes of the two bending arms 225*c* relative to the first cover lateral side 220*c* are only illustrated schematically. Although the greater the sizes of the two bending anus 225*c* are, the better interval is provided, since the bending arms 225*c* is formed by the partial regions of the first cover lateral side 220*c*, when the sizes of the two bending arms 225*c* are excessively large, the sizes of the cracking holes 224*c* on the first cover lateral side 220*c* are excessively large accordingly, such that a structural strength of the first cover lateral side 220*c* is weakened. Therefore, a designer can design the sizes of the bending arms according to an actual design requirement to achieve a balance between the structural strength of the first cover lateral side 220*c* and the interval between the first cover lateral side 220*c* and the first connector concave 132. Certainly, in other embodiments, the two bending arms 225*c* located at different heights can also be staggered from each other without locating besides the same cracking hole 224*c*.

Referring to the embodiment of FIG. 4 to FIG. 7, in the present embodiment, the PCI-E connector cover 200 further includes a plurality of connecting posts 250. The connecting posts 250 are extended from the first cover lateral side 220 and the second cover lateral side 230, such that the PCI-E connector cover 200 can be connected to the main board through the connecting posts 250. Namely, the PCI-E connector cover 200 of the present embodiment can be fixed to the main board together with the pins of the PCI-E connector 100 though the connecting posts 250 (for example, the connecting posts 250 and the pins of the PCI-E connector 100 are inserted to corresponding holes on the main board, and a solder is filled therein), such that the PCI-E connector cover 200 can stably cover the PCI-E connector 100.

In the present embodiment, the number of the connecting posts 250 extended from the first cover lateral side 220 is three, and the number of the bending arms 225 extended from the first cover lateral side 220 is five, and the five bending an is 225 are located close to the connecting posts 250 of the first cover lateral side 220. By configuring the bending arms 225 close to the connecting posts 250, the first cover lateral side 220 of the PCI-E connector cover 200 is avoided to be deformed inward, so as to facilitate aligning the connecting posts 250 with the corresponding holes on the main board. Certainly, the numbers and positions of the connecting posts and the bending arms 225 are not limited thereto.

As shown in FIG. 4 to FIG. 7, in the present embodiment, the connecting post 250 has a rough surface 252, which may increase adhesion of the solder. In the present embodiment, the rough surface 252 have a plurality of diamond protrusions (FIG. 15), such that the surface is not flat and smooth, and the rough surface 252 can be formed through stamping. However, in other embodiment, regular or irregular stripes can be scratched on the connecting posts 250 to form the rough surface 252. Alternatively, the rough surface 252 can be formed on the connecting posts 250 through sandblasting. The patterns and methods for forming the rough surface 252 on the connecting posts 250 are not limited to the aforementioned description.

Figure 17:
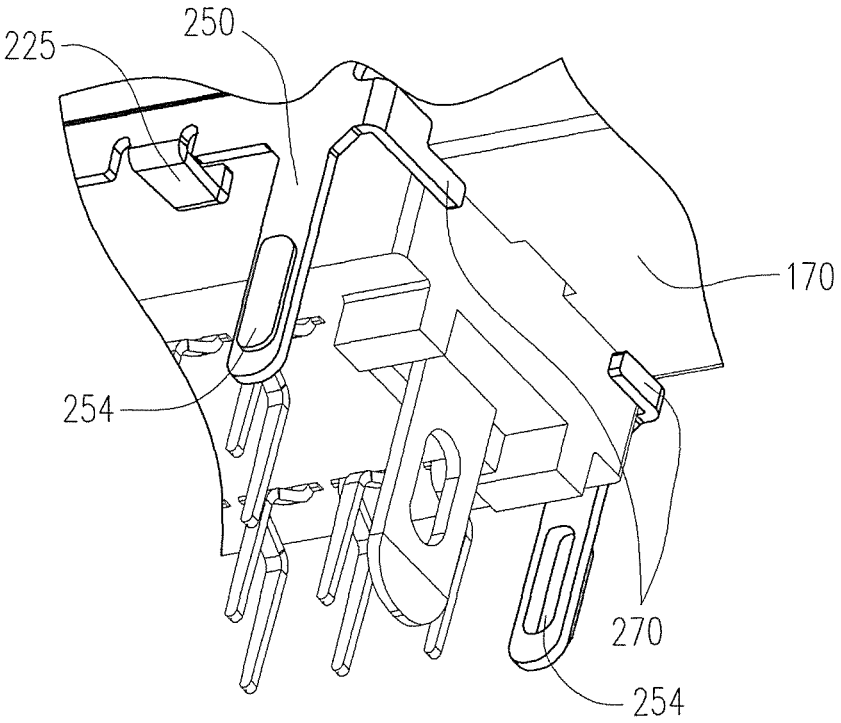
FIG. 17 is a partial schematic diagram of a PCI-E connector module according to another embodiment of the invention.
Figure 18:
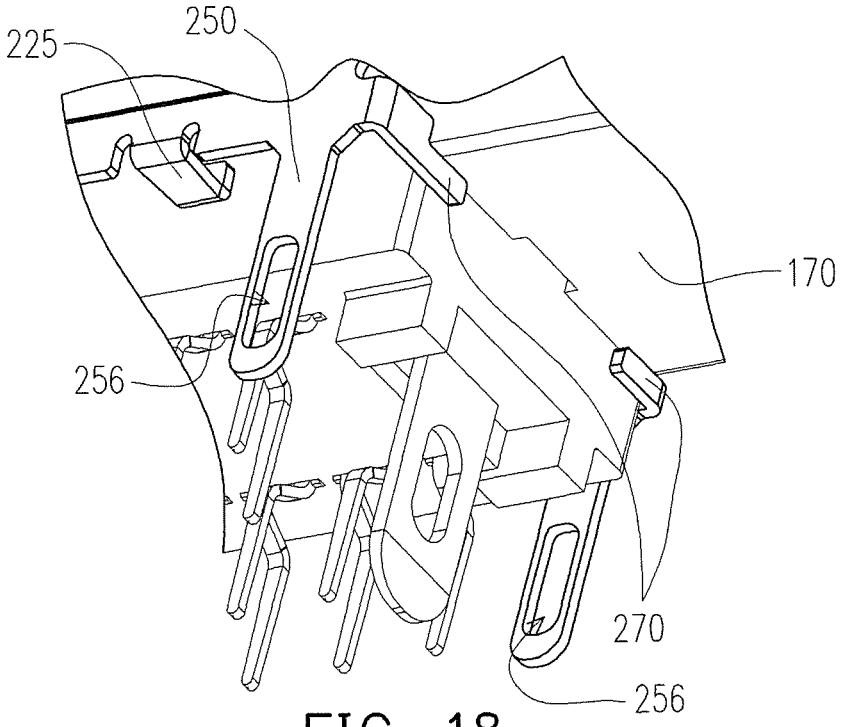
FIG. 18 is a partial schematic diagram of a PCI-E connector module according to another embodiment of the invention.

Certainly, in other embodiments, a connection strength for connecting the connecting posts 250 to the main board can be enhanced through other methods. For example, unbroken bending portions 254 (as shown in FIG. 17) or broken cracking holes 256 (as shown in FIG. 18) can be formed on the connecting posts 250 through stamping. When the connecting posts 250 are fixed to the main board, a part of the solder is filled in a concave part of the bending portions 254 or in the cracking holes 256, so as to enhance the connection strength for connecting the connecting posts 250 to the main board.

It should be noticed that in the present embodiment, the connecting posts 250 are grounding posts, namely, when the connecting posts 250 are fixed to the main board, the connecting posts 250 contact a grounding line of the main board to achieve a grounding effect. Namely, besides that the connecting posts 250 of the PCI-E connector cover 200 have a fixing function, the connecting posts 250 may also provide an electromagnetic interference protection effect to the PCI-E connector 100.

Moreover, in the present embodiment, in order to avoid decreasing a space on the main board due to configuration of the PCI-E connector cover 200 on the PCI-E connector 100, a thickness of the PCI-E connector cover 200 is limited. For example, in the present embodiment, the thickness of the PCI-E connector cover is about 0.3 cm. However, such thin metal plate generally has poor rigidity, in the present embodiment, the first cover lateral side 220 and the second cover lateral side 230 of the PCI-E connector cover 200 have a special design, such that the PCI-E connector cover 200 with a smaller thickness still has an enough strength to protect the PCI-E connector 100.

Further, in the present embodiment, the first cover lateral side 220 has a first cover concave 222, and the second cover lateral side 230 has a second cover concave 232. Since a rigidity of the metal is enhanced after bending and stamping of the metal, the whole structural strength of the PCI-E connector cover 200 of the present embodiment is further enhanced through the bended first cover concave 222 and the bended second cover concave 232. Certainly, in other embodiments, an implementation that only the first cover lateral side 220 has the first cover concave 222, or only the second cover lateral side 230 has the second cover concave 232 is also applicable.

It should be noticed that in the present embodiment, shapes and positions of the first cover concave 222 and the second cover concave 232 are not particularly complied with the shapes and positions of the first connector concave 132 and the second connector concave 142. Namely, the first cover concave 222 and the second cover concave 232 of the PCI-E connector cover 200 are not matched in contours with the first connector concave 132 and the second connector concave 142 of the PCI-E connector 100.

Certainly, in other embodiments, the shapes and positions of the first cover concave 222 and the second cover concave 232 can also be complied with the shapes and positions of the first connector concave 132 and the second connector concave 142. Namely, in other embodiments, the first cover concave 222 and the second cover concave 232 of the PCI-E connector cover 200 are matched in contours with the first connector concave 132 and the second connector concave 142 of the PCI-E connector 100. Moreover, such match design results in a fact that the PCI-E connector cover 200 has a smaller volume. In other words, when the PCI-E connector cover 200 and the PCI-E connector 100 are all assembled to the main board, a relatively less space on the main board is occupied.

Figure 14:
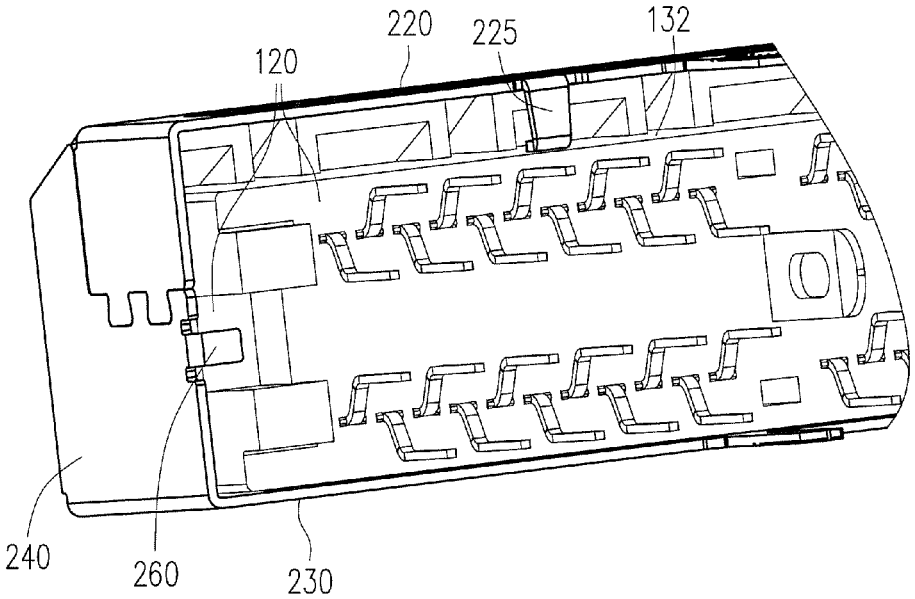
FIG. 14 and FIG. 15 are partial schematic diagrams of the PCI-E connector module of FIG. 4 viewing along other viewing angles.
Figure 15:
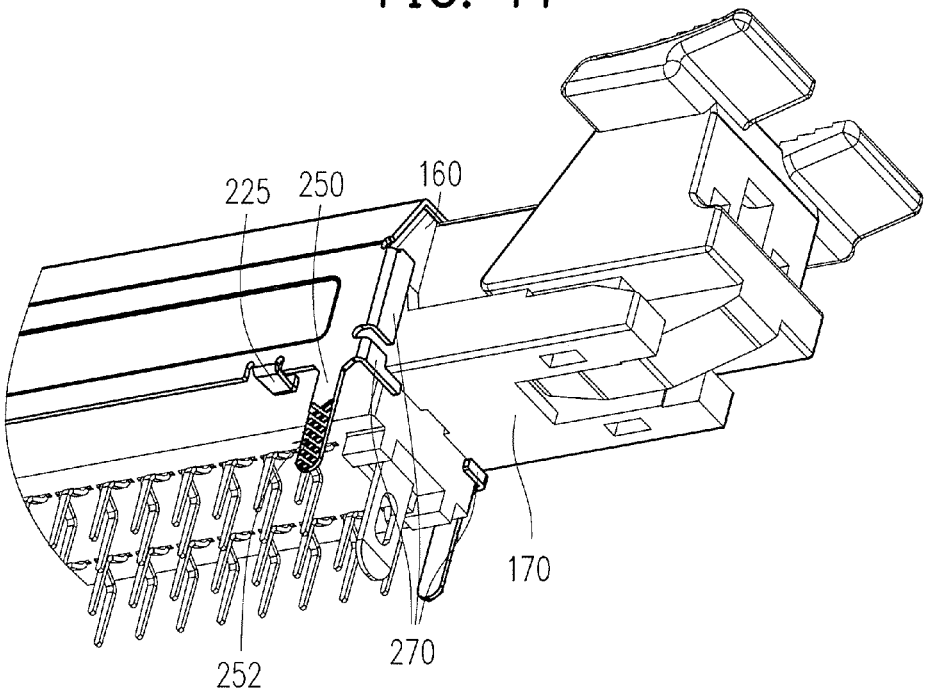

FIG. 14 and FIG. 15 are partial schematic diagrams of the PCI-E connector module of FIG. 4 viewing along other viewing angles. Referring to FIG. 14 and FIG. 15, in the present embodiment, the PCI-E connector cover 200 is fixed on the PCI-E connector 100 through buckling. The PCI-E connector cover 200 further includes a first buckling portion 260 and at least one second buckling portion 270. In detail, in the present embodiment, the first buckling portion 260 is extended from the third cover lateral side 240. The number of the at least one second buckling portion 270 is four, where two of the second buckling portions 270 are extended from the first cover lateral side 220, and the other two second buckling portions 270 are extended from the second cover lateral side 230.

When the PCI-E connector cover 200 covers the PCI-E connector 100, the cover top surface 210 of the PCI-E connector cover 200 covers the connector top surface 110 of the PCI-E connector 100, the first buckling portion 260 of the PCI-E connector cover 200 can be bended for buckling the connector bottom surface 120 (shown in FIG. 8, FIG. 9 and FIG. 14) of the PCI-E connector 100, and the second buckling portions 270 respectively extended from the first cover lateral side 220 and the second cover lateral side 230 are bended for buckling the fourth connector lateral side 160 of the PCI-E connector 100 and are located under the extending post 170, such that the PCI-E connector 100 is limited within the PCI-E connector cover 200 along an up-down direction.

Meanwhile, the third cover lateral side 240 of the PCI-E connector cover 200 covers the third connector lateral side 150 of the PCI-E connector 100, and the four second buckling portions 270 of the PCI-E connector cover 200 are bended for buckling the fourth connector lateral side 160 (shown in FIG. 4, FIG. 6 and FIG. 15) of the PCI-E connector 100, such that the PCI-E connector 100 is limited within the PCI-E connector cover 200 along a left-right direction.

Moreover, the bending arms 225 of the PCI-E connector cover 200 lean against the first connector concave 132 of the first connector lateral side 130 of the PCI-E connector 100, the second cover lateral side 230 of the PCI-E connector cover 200 covers the second connector lateral side 140 of the PCI-E connector 100, and the two second buckling portions 270 extended from the first cover lateral side 220 and one of the second buckling portions 270 extended from the second cover lateral side 230 lean against two sides of the extending post 170, such that the PCI-E connector 100 is limited within the PCI-E connector cover 200 along a front-rear direction.

Namely, in the present embodiment, the PCI-E connector cover 200 can be stably fixed to the PCI-E connector 100 along three-dimensional directions through the aforementioned structural design, so as to avoid shaking and shift. It should be noticed that only one implementation of fixing the PCI-E connector cover 200 to the PCI-E connector 100 is described, and in other embodiments, the number and positions of the second buckling portions 270 are not limited thereto.

Figure 16:
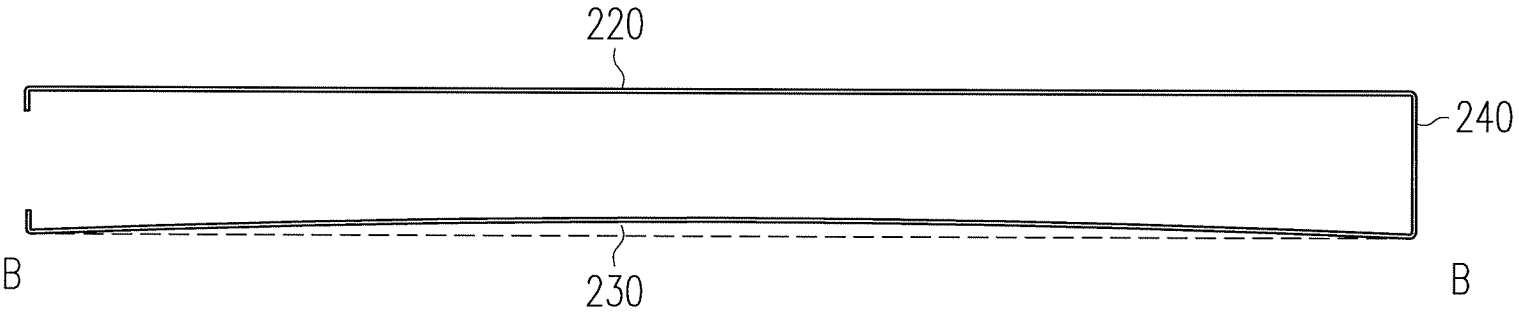
FIG. 16 is a cross-sectional view of the PCI-E connector cover of FIG. 6 along a B-B line.

Moreover, in order to ensure that the second cover lateral side 230 of the PCI-E connector cover 200 is closely attached to the second connector lateral side 140 of the PCI-E connector 100 when the PCI-E connector cover 200 is installed to the PCI-E connector 100, the PCI-E connector cover 200 is tightly fixed to the PCI-E connector 100 along the front-rear direction. FIG. 16 is a cross-sectional view of the PCI-E connector cover of FIG. 6 along a B-B line. It should be noticed that FIG. 16 only illustrates a cross-section of the PCI-E connector cover 200 along the B-B-line of FIG. 6 without illustrating the PCI-E connector 100, and in FIG. 16, the PCI-E connector cover 200 is not yet installed on the PCI-E connector 100.

Figure 6:
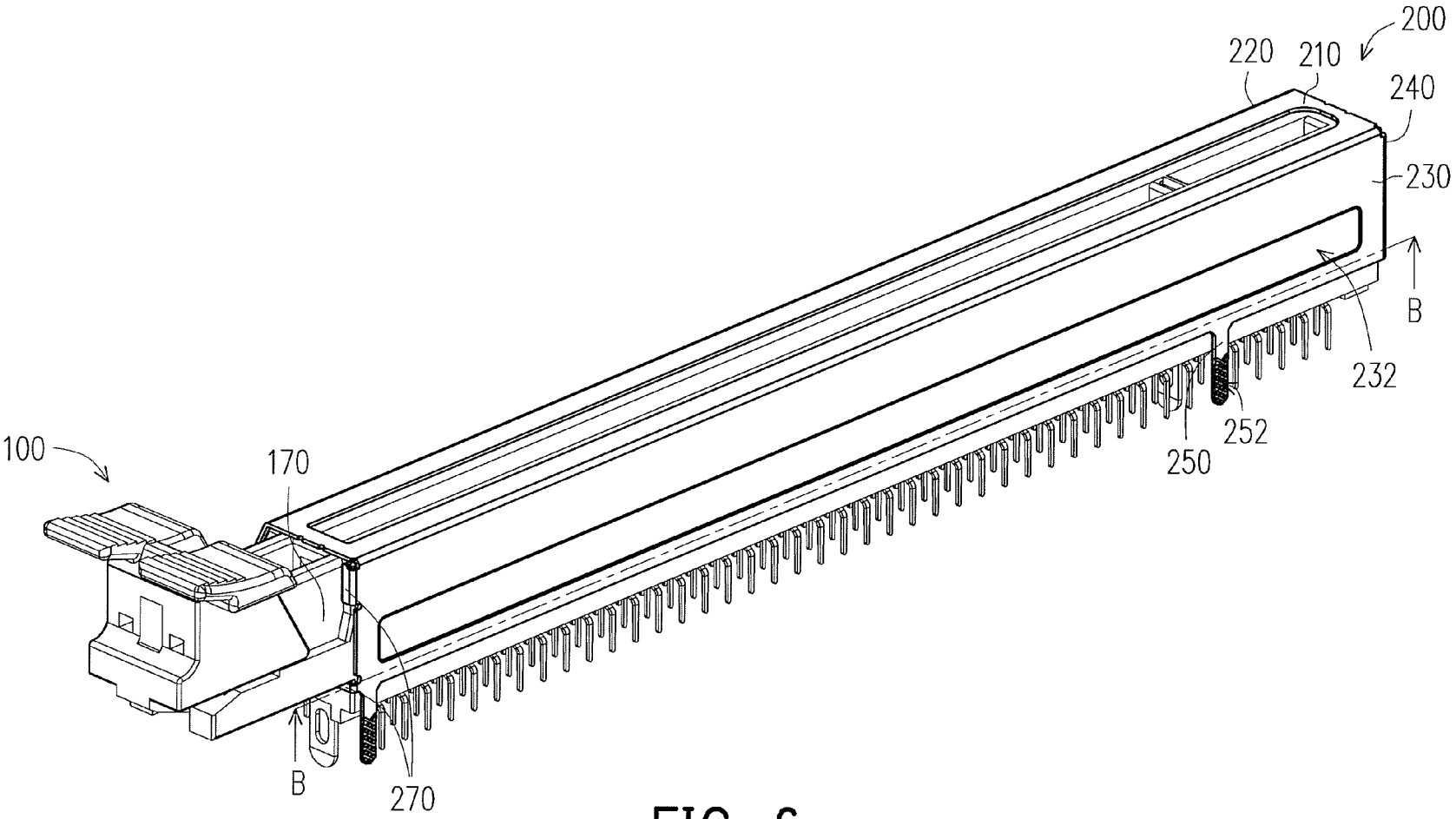
Figure 7:
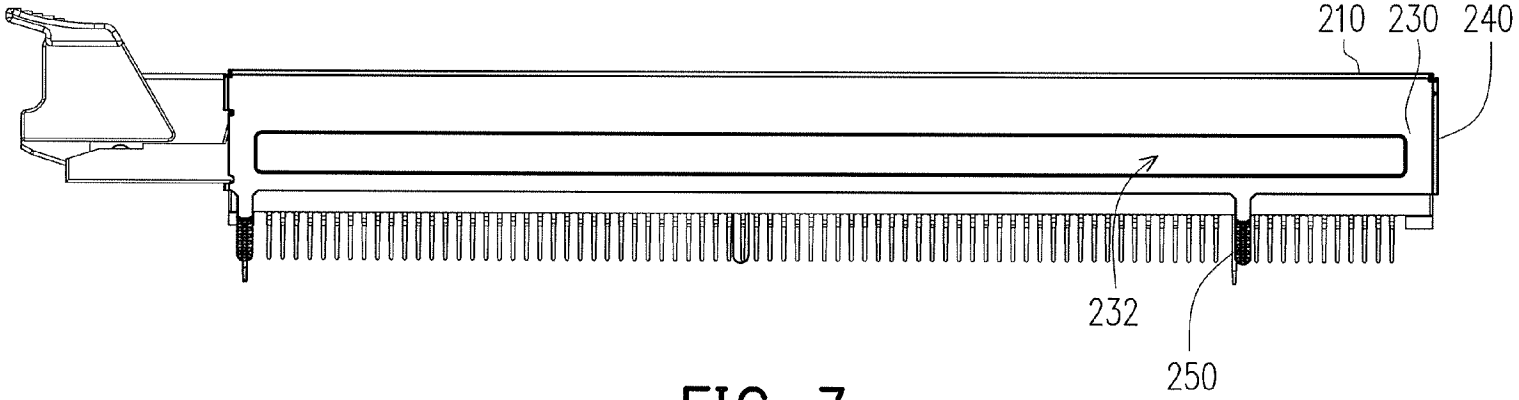

Referring to FIG. 6 and FIG. 16, in the present embodiment, the second cover lateral side 230 has a curvature concaving towards the first cover lateral side 220. In the present embodiment, since the PCI-E connector cover 200 made of a metal material is slightly flexible, based on the design that the second cover lateral side 230 has the curvature, when the PCI-E connector cover 200 is installed on the PCI-E connector 100, the PCI-E connector 100 slightly expands the PCI-E connector cover 200, such that the second cover lateral side 230 of the PCI-E connector cover 200 can be closely attached to the second connector lateral side 140 of the PCI-E connector 100.

Certainly, in other embodiments, the first cover lateral side 220 may have a curvature concaving towards the second cover lateral side 230 to make the PCI-E connector cover 200 to be closely installed on the PCI-E connector 100 along the front-rear direction. Alternatively, in the other embodiments, both of the first cover lateral side 220 and the second cover lateral side 230 may have a curvature concaving towards each other.

In summary, the cover top surface of the PCI-E connector cover of the PCI-E connector module of the invention is connected to the first cover lateral side and the second cover lateral side, and the cover top surface, the first cover lateral side and the second cover lateral side are adapted to cover the connector top surface, the first connector lateral side and the second connector lateral side of the PCI-E connector to enhance a structural strength of the PCI-E connector. Moreover, the bending arms connected to the first cover lateral side lean against the first connector concave of the PCI-E connector, such that a certain interval is kept between the first cover lateral side of the PCI-E connector cover and the first connector concave of the PCI-E connector to avoid a situation that the PCI-E connector cover is sunk and deformed under pressure. Moreover, the PCI-E connector cover is stably connected to the main board through the connecting posts in a welding manner.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A peripheral component interconnect express (PCI-E) connector cover, adapted to cover a PCI-E connector and fixed to a main board, wherein the PCI-E connector comprises a connector top surface and a connector bottom surface opposite to each other, a first connector lateral side and a second connector lateral side opposite to each other, a third connector lateral side and a fourth connector lateral side opposite to each other, the first connector lateral side comprises a first connector concave and a plurality of connector protrusions, and the second connector lateral side comprises a second connector concave, the PCI-E connector cover comprising:

a first cover lateral side, adapted to cover the first connector lateral side;

a plurality of bending anus, connected to the first cover lateral side and adapted for leaning against the first connector concave to keep an interval between the first cover lateral side and the first connector concave;

a second cover lateral side, adapted to cover the second connector lateral side;

a cover top surface, connected to the first cover lateral side and the second cover lateral side, and adapted to cover the connector top surface; and a plurality of connecting posts, extended from the first cover lateral side and the second cover lateral side, wherein the PCI-E connector cover is adapted to be connected to the main board through the connecting posts, wherein the second cover lateral side has a curvature concaving towards the first cover lateral side, or the first cover lateral side has a curvature concaving towards the second cover lateral side.

2. The PCI-E connector cover as claimed in claim 1, wherein the bending arms are extended from an edge of the first cover lateral side and are bended towards the first connector concave.

3. The PCI-E connector cover as claimed in claim 1, wherein the bending arms are formed by cracking and bending a plurality partial regions of the first cover lateral side at non-edge areas, such that the first cover lateral side has a plurality of cracking holes besides the bending arms.

4. The PCI-E connector cover as claimed in claim 3, wherein the bending arms contact or do not contact the connector protrusions of the first connector lateral side.

5. The PCI-E connector cover as claimed in claim 1, wherein the first cover lateral side has a first cover concave, or the second cover lateral side has a second cover concave.

6. The PCI-E connector cover as claimed in claim 1, wherein the connecting posts are grounding posts.

7. The PCI-E connector cover as claimed in claim 1, wherein each of the connecting posts has a rough surface, a bending portion or a cracking hole.

8. The PCI-E connector cover as claimed in claim 1, further comprising:

a third cover lateral side, connected to at least two of the cover top surface, the first cover lateral side and the second cover lateral side, and adapted to cover the third connector lateral side;

a first buckling portion, extended from the third cover lateral side; and at least one second buckling portion, extended from the first cover lateral side or the second cover lateral side, wherein the first buckling portion and the at least one second buckling portion are adapted to bend for respectively buckling the connector bottom surface and the fourth connector lateral side of the PCI-E connector.

9. The PCI-E connector cover as claimed in claim 8, wherein the at least one second buckling portion comprises two second buckling portions respectively extended from the first cover lateral side and the second cover lateral side.

10. A PCI-E connector module, adapted to be fixed to a main board, the PCI-E connector module comprising:

a PCI-E connector, comprising:

a connector top surface;

a connector bottom surface, opposite to the connector top surface;

a first connector lateral side, connected to the connector top surface and the connector bottom surface and comprising a first connector concave;

a second connector lateral side, connected to the connector top surface and the connector bottom surface and opposite to the first connector lateral side, and comprising a second connector concave;

a third connector lateral side, connected to the connector top surface, the connector bottom surface, the first connector lateral side and the second connector lateral side; and a fourth connector lateral side, opposite to the third connector lateral side, and connected to the connector top surface, the connector bottom surface, the first connector lateral side and the second connector lateral side; and a PCI-E connector cover, disposed on the PCI-E connector, and comprising:

a first cover lateral side, covering the first connector lateral side;

a plurality of bending arms, connected to the first cover lateral side and leaning against the first connector concave to keep an interval between the first cover lateral side and the first connector concave;

a second cover lateral side, covering the second connector lateral side;

a cover top surface, connected to the first cover lateral side and the second cover lateral side, and covering the connector top surface; and a plurality of connecting posts, extended from the first cover lateral side and the second cover lateral side, wherein the PCI-E connector cover is adapted to be connected to the main board through the connecting posts, wherein the second cover lateral side has a curvature concaving towards the first cover lateral side, or the first cover lateral side has a curvature concaving towards the second cover lateral side.

11. The PCI-E connector module as claimed in claim 10, wherein the bending arms are extended from an edge of the first cover lateral side and are bended towards the first connector concave.

12. The PCI-E connector module as claimed in claim 10, wherein the bending arms are formed by cracking and bending a plurality partial regions of the first cover lateral side at non-edge areas, such that the first cover lateral side has a plurality of cracking holes besides the bending arms.

13. The PCI-E connector module as claimed in claim 12, wherein the bending arms contact or do not contact the connector protrusions of the first connector lateral side.

14. The PCI-E connector module as claimed in claim 10, wherein the first cover lateral side has a first cover concave, or the second cover lateral side has a second cover concave.

15. The PCI-E connector module as claimed in claim 10, wherein the connecting posts are grounding posts.

16. The PCI-E connector module as claimed in claim 10, wherein each of the connecting posts has a rough surface, a bending portion or a cracking hole.

17. The PCI-E connector module as claimed in claim 10, wherein the PCI-E connector cover further comprises:

a third cover lateral side, connected to at least two of the cover top surface, the first cover lateral side and the second cover lateral side, and covering the third connector lateral side;

a first buckling portion, extended from the third cover lateral side; and at least one second buckling portion, extended from the first cover lateral side or the second cover lateral side, wherein the first buckling portion and the at least one second buckling portion are bent for respectively buckling the connector bottom surface and the fourth connector lateral side of the PCI-E connector.

18. The PCI-E connector module as claimed in claim 17, wherein the at least one second buckling portion comprises two second buckling portions respectively extended from the first cover lateral side and the second cover lateral side.

* * * * *